US007458838B2

(12) United States Patent
Itou

(10) Patent No.: US 7,458,838 B2
(45) Date of Patent: Dec. 2, 2008

(54) FLUIDTIGHT CONNECTOR

(75) Inventor: Tomonari Itou, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/965,844

(22) Filed: Dec. 28, 2007

(65) Prior Publication Data

US 2008/0160813 A1 Jul. 3, 2008

(30) Foreign Application Priority Data

Dec. 28, 2006 (JP) ..... 2006-354198

(51) Int. Cl.
*H01R 13/52* (2006.01)

(52) U.S. Cl. ..... 439/281; 439/271

(58) Field of Classification Search ..... 439/271, 439/272, 273, 281, 282, 587, 275
See application file for complete search history.

(56) References Cited

U.S. PATENT DOCUMENTS 5,470,248 A * 11/1995 Wood ..... 439/281
5,580,266 A * 12/1996 Shelly ..... 439/281
6,053,754 A * 4/2000 Kano et al. ..... 439/281
2003/0171020 A1 * 9/2003 Shibata ..... 439/271

FOREIGN PATENT DOCUMENTS

| | | |
|---|---|---|
| JP | 2005-183342 | 7/2005 |
| JP | 2006-147248 | 6/2006 |
| WO | WO 2006/054574 | 5/2006 |

* cited by examiner

*Primary Examiner*—Hien Vu
(74) *Attorney, Agent, or Firm*—Gerald E. Hespos; Anthony J. Casella

(57) ABSTRACT

When a male housing (10) and a female housing (20) are connected, projections (15) formed in the male housing (10) are pressed into fitting holes (36) of a seal (27) mounted on the front surface of a terminal accommodating portion (20A) after passing through projecting-portion insertion holes (32) formed in a cover wall (28) of the female housing (20). Shaking is prevented by shake preventing portions (16) projecting from the outer circumferential surfaces of the projections (15), thereby suppressing relative vibration of the housings (10, 20) and preventing fine sliding abrasion of male tabs (14) and female terminal fittings (40).

15 Claims, 4 Drawing Sheets

FLUIDTIGHT CONNECTOR

BACKGROUND OF THE INVENTION

1. Field of the Invention

The invention relates to a fluidtight connector, particularly to a watertight connector.

2. Description of the Related Art

Japanese Unexamined Patent Publication No. 2005-183342 discloses a watertight connector with a male housing and a female housing that are connectable with each other. The female housing includes a terminal accommodating portion formed with cavities for receiving female terminals. An outer tube surrounds the terminal accommodating portion and a rubber ring is mounted on the outer peripheral surface of the terminal accommodating portion.

A receptacle of the male housing is fit into a space between the rubber ring and the outer tube in the female housing. As a result, the rubber ring is squeezed between the receptacle and the terminal accommodating portion to provide sealing between the two housings, and all of the cavities are made watertight at once. However, a space for the rubber ring must be provided on the outer periphery of the terminal accommodating portion, and enlarges the connector in a direction normal to the longitudinal direction of the connector.

Japanese Unexamined Patent Publication No. 2006-147248 discloses a connector that attempts to achieve miniaturization by mounting a sheet-like sealing member before the terminal accommodating portion with respect to a connecting direction with the male housing instead of mounting the rubber ring on the outer periphery of the terminal accommodating portion.

The sealing member is secured to the rear surface of a holder and closely contacts the front surface of the terminal accommodating portion when the holder is mounted on the front side of the terminal accommodating portion. On the other hand, projections are formed on the front surface of the male housing and cover base ends of forwardly projecting male terminals.

The projections pass through holes in the holder when the housings are connected and are pressed into fitting holes in the sealing member for closely contacting peripheral surfaces of the fitting holes over the entire peripheries. As a result, the cavities of the female housing are made watertight.

However, relative vibration of the two housings is more likely to occur in the latter construction than in the former construction where the two housings are held in close contact over the entire circumference via the rubber ring. This might cause fine sliding abrasion to peel off gold plating due to the abrasion of the terminals.

The invention was developed in view of the above, and an object thereof is to provide a watertight connector miniaturized by mounting a sealing member before a terminal accommodating portion and capable of suppressing relative vibration of housings and preventing fine sliding abrasion of terminals.

SUMMARY OF THE INVENTION

The invention relates to a fluidtight connector with first and second housings that are connectable with each other. At least one first terminal is accommodated in the first housing and projects from the first housing in a connecting direction with the second housing for connection with at least one second terminal in the second housing. A terminal accommodating portion is provided in the second housing and includes at least one cavity for accommodating the second terminal and at least one terminal insertion hole for receiving the first terminal. At least one seal is mounted on a front surface of the terminal accommodating portion with respect to a connecting direction with the first housing and is capable of being held in close contact with the front surface in an area where the terminal insertion hole is formed. A cover wall is provided in the second housing for at least partly covering the front side of the seal with respect to the connecting direction. At least one through hole penetrates the cover wall in the connecting direction at a position corresponding to the terminal insertion hole. At least one projection projects from the first housing and at least partly covers the outer peripheral surface of a base end portion of the first terminal. The projection can be passed through the through hole and has an outer shape closely contacting substantially the entire periphery of the through hole. At least one shake preventing portion projects from the outer peripheral surface of the projection and the inner peripheral surface of the through hole for closely contacting the inner peripheral surface of the through hole and the outer peripheral surface of the projection.

At least one fitting hole preferably penetrates the seal substantially in the connecting direction at a position corresponding to the terminal insertion hole and at a position corresponding to the through hole in the cover wall.

The projection preferably is formed on a surface of the first housing where the first terminal projects.

The at least one projection preferably has an outer shape for passing through the through hole and closely contacting the fitting hole over substantially the entire periphery.

The first and second terminals are connected when the pair of housings are connected, and the projection formed in the first housing passes through the through hole formed in the cover wall of the second housing and is pressed into the fitting hole of the seal mounted on the front surface of the terminal accommodating portion. The projection closely contacts the fitting hole over the entire periphery to make the inside of the cavity watertight. Further, the shake preventing portion projects from the outer peripheral surface of the projection or the inner peripheral surface of the through hole to suppress relative vibration of the housings.

Accordingly, relative vibration of the housings is suppressed and fine sliding abrasion of the terminals is prevented in a watertight connector that is miniaturized by mounting the seal before the terminal accommodating portion. Further, shaking is prevented at the position of the through hole of the cover wall, which is close to the connected position of the terminals. Therefore, fine sliding abrasion is prevented very effectively.

Plural shake preventing portions preferably are arranged at positions substantially equally spaced around the outer circumferential surface of the projection and/or the inner circumferential surface of the through hole. Shaking is prevented in a well-balanced manner by the plural shake preventing portions. Therefore, relative vibration of the two housings is suppressed reliably, with the result that fine sliding abrasion of the terminals is prevented.

At least two shake preventing portions preferably are arranged at substantially opposite positions with respect to an axial line of the projection and/or the through hole. Thus, the projection is held tightly between two opposed shake preventing portions for reliably suppressing relative vibration.

The shake preventing portion preferably extends over the entire length of the through hole in a penetrating direction. Accordingly, the through hole and the projection are held in close contact over the entire length of the through hole in the penetrating direction. As a result, shaking is prevented more reliably than in a case where only parts of the through hole and the projection are in contact. Therefore, relative vibration of the housings is suppressed more reliably.

Rear ends of the projections preferably are fit into the projection insertion holes while having the shake preventing portions squeezed or deformed.

Projecting pieces preferably are formed on the rear surface of the cover wall and can be inserted into parts of the cavities of the terminal accommodating portion to form front end sections of the cavities.

The projecting pieces preferably have lengths to reach positions immediately before locks in the cavities for locking the second terminal therein.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
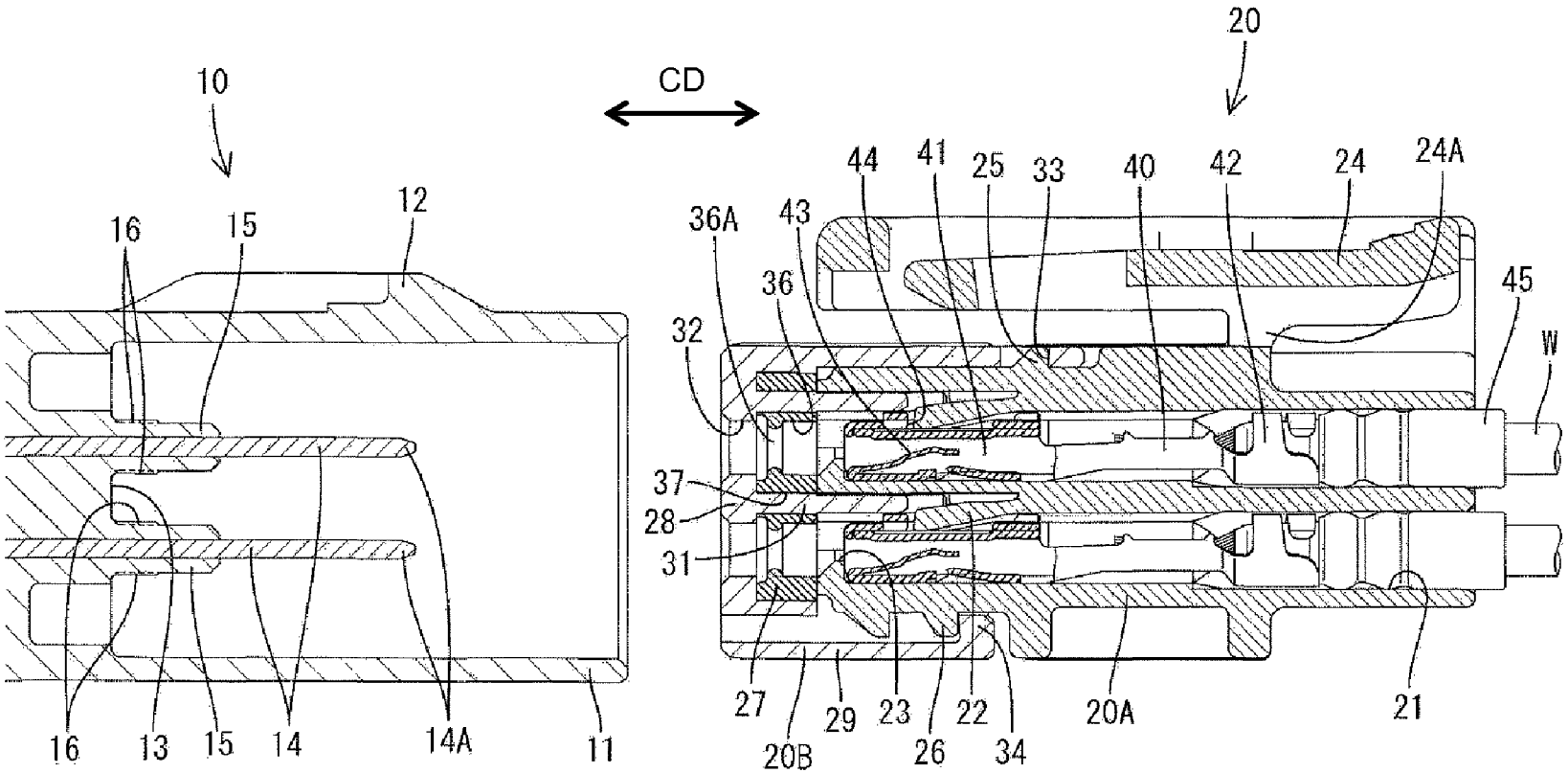
FIG. 1 is a side view in section showing a state where a watertight connector according to one embodiment is connected.
Figure 3:
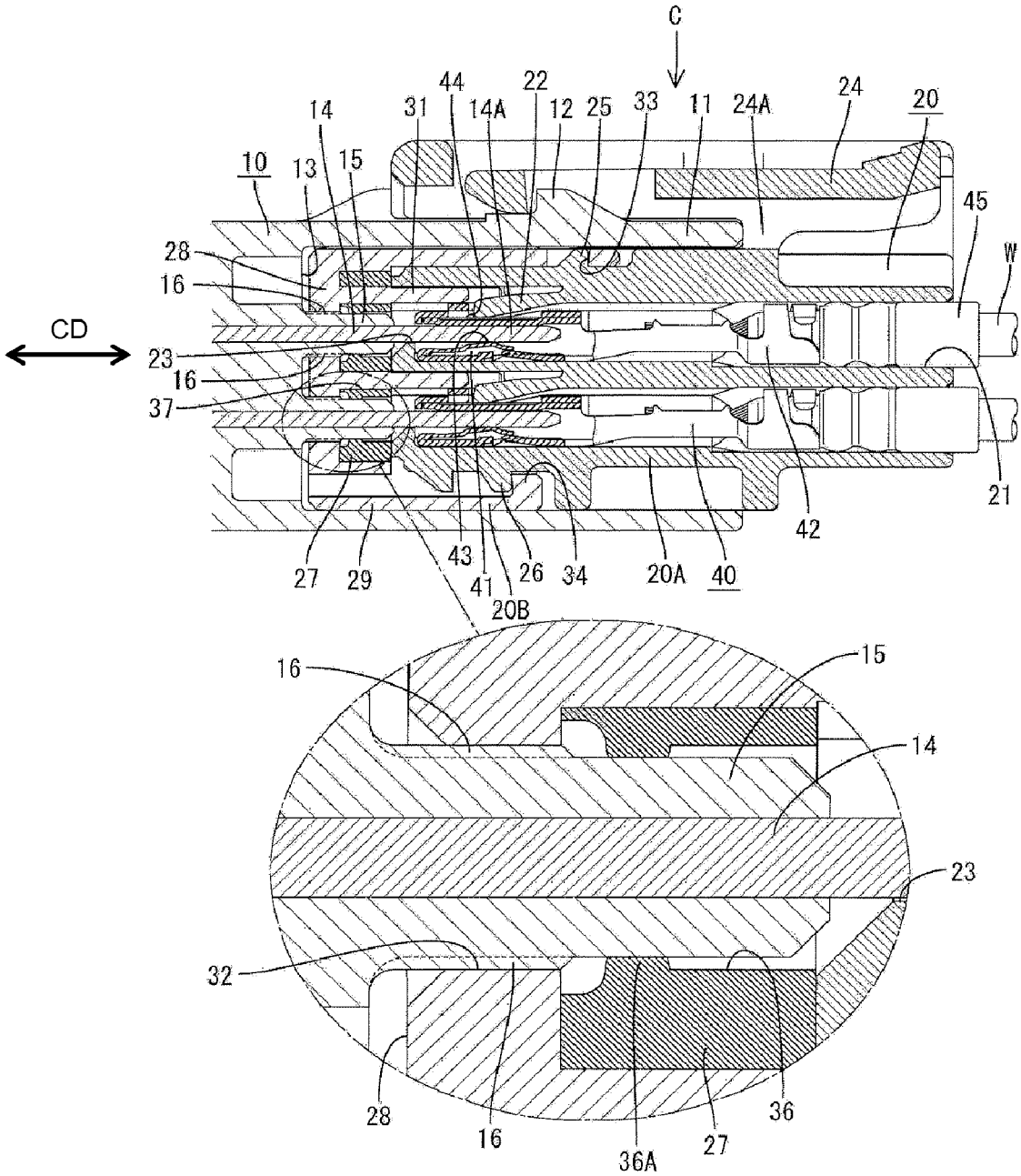
FIG. 3 is a side view in section showing a state where the watertight connector is properly connected.
Figure 4:
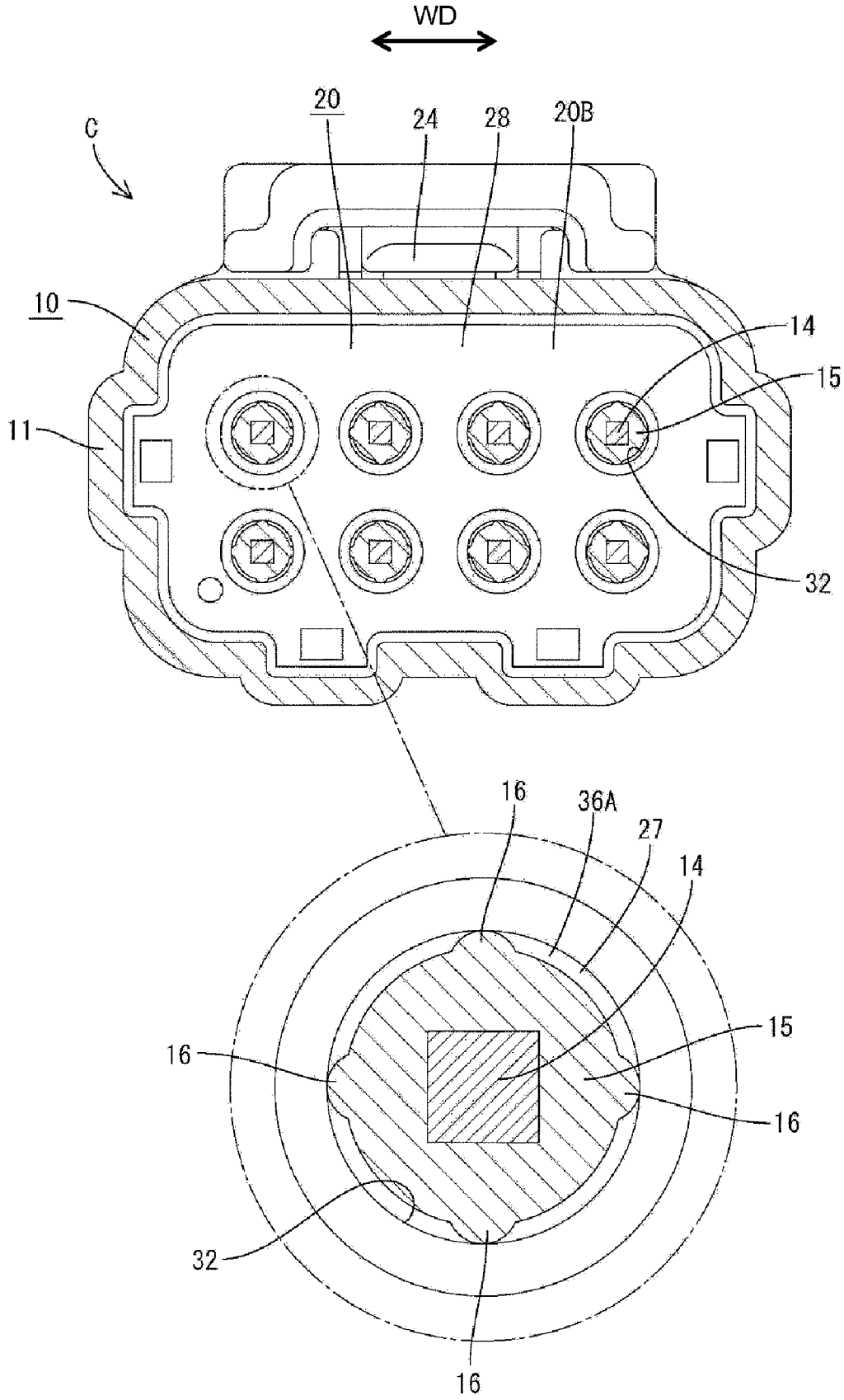
FIG. 4 is a front view in section showing a state where projecting portions are inserted in projecting-portion insertion holes.

A fluid- or watertight connector is identified by the letter C in FIGS. 3 and 4 and includes a male housing 10 and a female housing 20 that are connectable with each other as shown in FIG. 1. In the following description, ends of the two housings 10, 20 to be connected are referred to as the front ends and reference is made to FIG. 1 concerning upper and lower sides.

The male housing 10 includes a forwardly open tubular receptacle 11 that projects from a side wall of an electric device. It should be understood, however, that the invention is also applicable to connectors provided at an end of a wiring harness or the like. The receptacle 11 is shaped so that the female housing 20 can be inserted therein from the front. A lock projection 12 is provided at a widthwise intermediate position of the upper surface of the receptacle 11 for engagement with a lock arm 24 of the female housing 20.

Male tabs 14 project forward from a back surface 13 of the receptacle 11 along a connecting direction CD of the housings 10, 20. The male tabs 14 are aligned in a width direction WD at each of upper and lower stages. A connecting portion 14A is defined at a front projecting part of each male tab 14 and can be inserted into a main portion 41 of a corresponding female terminal fitting 40 to be described later and to be electrically connected with the female terminal fitting 40.

Projections 15 project forward from the back surface 13 of the male housing 10 and individually surround the outer peripheries of base end portions of the respective male tabs 14 at positions behind the connecting portions 14A. The projections 15 have substantially cylindrical outer shapes (see FIG. 4). Each projection 15 has shake preventing portions 16, described in detail later.

Figure 2:
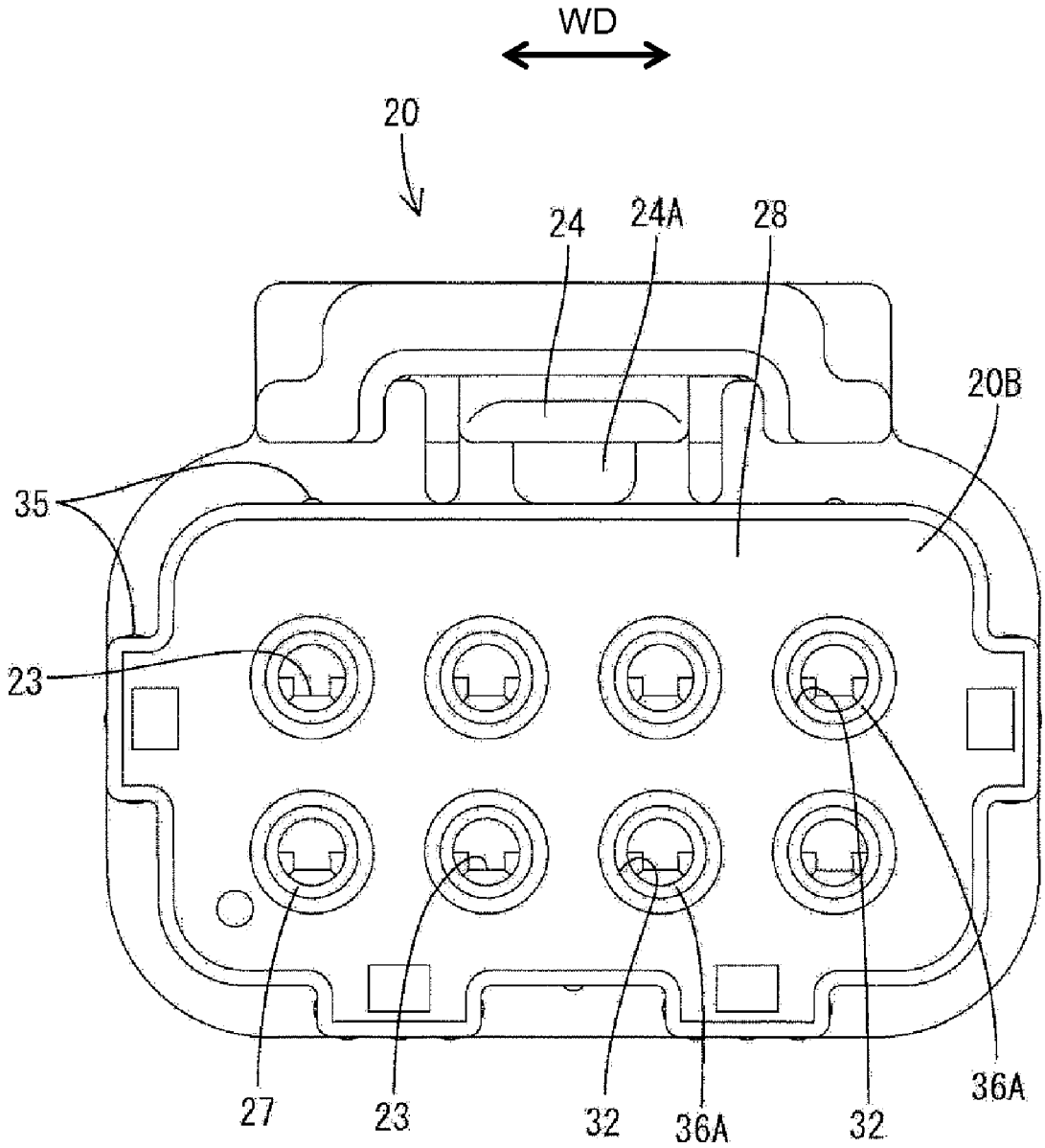
FIG. 2 is a front view of a female housing.

The female housing 20 has a wide flat shape, as shown in FIG. 2, and includes a terminal accommodating portion 20A for accommodating female terminal fittings 40 and a front holder 20B mountable on the front of the terminal accommodating portion 20A.

Cavities 21 penetrate the terminal accommodating portion 20A and the female terminal fittings 40 are insertable into the cavities 21. The cavities 21 are aligned in the width direction at upper and lower stages. A lock 22 is cantilevered forward from the ceiling of each cavity 21 and a front end of each lock 22 can engage a corresponding female terminal fitting 40 for retaining the female terminal fitting 40 in the respective cavity 21.

Each female terminal fitting 40 is formed by bending, folding and/or embossing a conductive metal plate stamped or cut out into a specified flat shape. Each female terminal fitting 40 has a substantially box-shaped main portion 41 for receiving the connecting portion 14A of the male tab 14. A crimping portion 42 is formed behind the main portion 41 and is configured to be crimped, bent or folded into connection with an end of a wire W.

A resilient contact piece 43 extends from the front end of the bottom wall of the main portion 41 and is folded back to cantilever into the main portion 41. The resilient contact piece 43 has a pointed or mountain-shape and can contact the connecting portion 14A of the male tab 14 by sandwiching the connecting portion 14A between the resilient contact piece 43 and the ceiling wall of the main portion 41 (see FIG. 3). The ceiling wall of the main portion 41 also has an engaging portion 44 for engaging the lock 22.

A rubber plug 45 is to be mounted on the insulation coating of each wire W. The rubber plug 45 is held in close contact with the inner circumferential surface of the rear end of each cavity 21 to prevent the entrance of fluid, such as water, into the cavity 21 from behind.

Terminal insertion holes 23 are formed in the front wall of the terminal accommodating portion 20A at positions corresponding to the cavities 21. The connecting portions 14A of the male tabs 14 are insertable through the terminal insertion holes 23 from the front and into the respective cavities 21.

The lock arm 24 is provided at a widthwise intermediate position of the upper surface of the terminal accommodating portion 20A and can be inclined resiliently about a support 24A like a seesaw.

An upper engaging projection 25 is provided at a position on the upper surface of the terminal accommodating portion 20A before the support 24A of the lock arm 24, and a lower engaging projection 26 is provided at a position on the bottom surface of the terminal accommodating portion 20A slightly before the upper) engaging projection 25. The upper and lower engaging projections 25, 26 are engaged with the front holder 20B to be described later.

The front holder 20B is mounted on the front of the terminal accommodating portion 20A. The front holder 20B is made e.g. of synthetic resin, and is substantially in the form of a cap capable of covering the front of the terminal accommodating portion 20A. The front holder 20B includes a cover wall 28 for covering the front surface of the terminal accommodating portion 20A and a surrounding wall 29 extending back from the peripheral edge of the cover wall 28.

Projecting pieces 31 are formed on the rear surface of the cover wall 28 and can be inserted into upper parts of the respective cavities 21 of the terminal accommodating portion 20A to form part of the front end sections of the ceiling walls of the cavities 21. The projecting pieces 31 have lengths to reach positions immediately before the locks 22.

Projection insertion holes 32 penetrate the cover wall 28 in forward and backward directions (wall thickness direction or connecting direction CD) at positions corresponding to the respective cavities 21 and below the respective projecting pieces 31. The respective projection insertion holes 32 are formed to receive the corresponding projections 15 of the female housing 10.

The surrounding wall 29 is formed to fit on a front end portion of the terminal accommodating portion 20A. An engaging hole 33 is formed at a position of the upper part of the surrounding wall 29 near the rear end and is engageable with the upper engaging projection 25 of the terminal accommodating portion 20A. An engaging protrusion 34 is formed at the rear end of the lower part of the surrounding wall 29 and is engageable with the lower engaging projection 26. The front holder 20B is held properly mounted on the terminal accommodating portion 20A by the engagement of the upper engaging projection 25 and the engaging hole 33 and the engagement of the lower engaging projection 26 and the engaging protrusion 34.

Protrusions 35 are formed on the outer peripheral surface of the female housing 20, as shown in FIG. 2. The protrusions 35 are squeezed when the female housing 20 is inserted into the receptacle 11 of the male housing 10, thereby making it difficult for the housings 10, 20 to shake relative to each other.

A seal 27 is secured to substantially the entire rear surface of the cover wall 28 of the front holder 20B. The seal 27 is made of an elastic or resilient or gelatinous material such as (natural or synthetic) rubber and has a substantially sheet-like shape. The seal 27 is held in close contact with the front surface of the terminal accommodating portion 20A when the front holder 20B and the terminal accommodating portion 20A are mounted properly.

Fitting holes 36 penetrate the sealing 27 in forward and backward directions (connecting direction CD) at positions corresponding to the respective projection insertion holes 32 of the cover wall 28. Thus, the respective projection insertion holes 32, fitting holes 36 and terminal insertion holes 23 are arranged to communicate with each other in forward and backward directions. Ribs 36A project in over substantially the entire circumference at front positions of the inner circumferential surfaces of the respective fitting holes 36. The ribs 36A can be held in close contact with the entire circumferences of the corresponding projections 15 pressed into the fitting holes 36. Sealing is provided between the male and female housings 10 and 20 by the close contact of the corresponding projections 15 and fitting holes 36 to prevent the entrance of water through the terminal insertion holes 23 and into the respective cavities 21. In this way, the seal 27 before the terminal accommodating portion 20A makes the connector C fluid- or watertight. In case of a gelatinous material, the fitting holes 36 may be formed upon connecting the female housing 20 with the male housing 10 when the male terminals pierce therethrough. The gelatinous or elastic material of the seal 27 may be a gel or elastic or rubbery material containing three-dimensional cross-linked molecular formations or a material that behaves as if it contained such molecular formations (geloids). For example, such a gel could be a silicone gel or resin. Another suitable gel comprises a block copolymer having relatively hard blocks (e.g. hydrogenated rubber blocks). Examples of such copolymers include styrene-diene block copolymers (linear or radial), for example styrene-butadiene or styrene-isoprene diblock or triblock copolymers, or styrene-ethylene-butylene-styrenes triblock copolymers. The gel may be formed from a single liquid material which becomes a gel when subjected e.g. to radiation or chemicals. Alternatively, the gel may be formed from two components, which become a gel when mixed, or the gel may be a composition which is a gel at working temperature, e.g. room temperature. Additionally or alternatively a gel material as disclosed in U.S. Pat. No. 4,875,870 may be used. Therefore, miniaturization can be better realized as compared to the case where the fluid- or watertight connector C is made fluid- or watertight by mounting a ring-shaped sealing member 27 on the outer periphery of the terminal accommodating portion 20A.

It should be noted that projecting-piece insertion holes 37 penetrate the seal 27 at positions substantially corresponding to the projecting pieces 31, and hence can receive the respective projective pieces 31.

The shake preventing portions 16 project from the outer peripheral surface of each projection 15 of the male housing 10. As shown in FIG. 4, the shake preventing portions 16 are provided at upper, lower, left and right sides of each projection 15. Thus, pairs of shake preventing portions 16 are arranged at opposite upper and lower positions and at opposite left and right positions with respect to an axial line of each projection 15. In other words, the shake preventing portions 16 are arranged at positions substantially equally dividing the entire circumference of each projection 15.

Each shake preventing portion 16 is of substantially semicircular shape along forward and backward directions. Projecting ends of the shake preventing portions 16 are squeezed and held in close contact with the inner circumferential surfaces of the projection insertion holes 32 when the respective projections 15 are inserted into the corresponding projection insertion holes 32.

The shake preventing portions 16 are provided at the rear or base ends of the respective projections 15 and extend in forward and backward directions along the projecting direction of the projections 15. A dimension of each shake preventing portion 16 in forward and backward directions is substantially equal to the thickness of the cover wall 28 (see FIG. 3). Thus, each shake preventing portion 16 extends along substantially the entire length of the corresponding projection insertion hole 32 in the penetrating direction.

The two housings 10, 20 are connected by pushing the female housing 20 into the receptacle 11 of the male housing 10 little by little. As a result, the connecting portions 14A of the male tabs 14 pass through the corresponding projection insertion holes 32, the fitting holes 36 and the terminal insertion holes 23 to enter the corresponding cavities 21. Additionally, the projections 15 pass through the corresponding the projection insertion holes 32 to enter fitting holes 36.

The connecting portions 14A of the male tabs 14 are inserted into the main portions 41 of the corresponding female terminal fittings 40 in the cavities 21 when the housings 10, 20 are connected properly. Thus, the connecting portions 14A are held between the resilient contact pieces 43 and the ceilings to achieve electrical connection, as shown in FIG. 3. Further, the front ends of the projections 15 are pressed into the corresponding fitting holes 36 of the seal 27 and are closely contacted by the ribs 36A over substantially the entire circumferences to provide sealing between the male and female housings 10 and 20 and to prevent entry of fluid or water into the cavities 21. Rear ends of the projections 15 are inserted into the projection insertion holes 32 so that the shake preventing portions 16 are squeezed. Accordingly, the projections 15 cannot shake relative to the projection insertion holes 32 and relative vibration of the two housings 10, 20 is prevented. The lock arm 24 and the lock projection 12 then engage to lock the two housings 10, 20 in a properly connected state. The protrusions 35 of the female housing 20 are squeezed when the housings 10, 20 are connected properly for further suppressing shaking of the two housings 10, 20.

The inability of the projections 15 to shake relative to the projection insertion holes 32 suppresses relative vibration of the two housings 10, 20 and prevents fine sliding abrasion between the male tabs 14 and the female terminal fittings 40 even if the connector C is subjected to vibration.

Shaking is prevented at all of the projections 15. Thus, relative vibration of the two housings 10, 20 is suppressed even during use under a severe vibration condition.

The projections 15 cover the base ends of the male tabs 14 to prevent shaking relative to the female housing 20, which is equivalent to a state where shaking of the male tabs 14 themselves relative to the female housing 20 is prevented. As a result, fine sliding abrasion between the connecting portions 14A of the male tabs 14 and the main portions 14 of the female terminal fittings 40 is suppressed reliably.

The projection insertion holes 32 are at positions very close to the connected positions of the male tabs 14 and the female terminal fittings 40. Thus, the relative shaking of the housings 10, 20 is prevented at these positions, and fine sliding abrasion is prevented more effectively.

The shake preventing portions 16 are disposed symmetrically around the circumference of each projection 15. Thus, each projection 15 is pressed in a well-balanced manner instead of being pressed strongly in one direction. Accordingly, shaking is prevented reliably regardless of the direction in which the watertight connector C vibrates, and relative vibration of the two housings 10, 20 is suppressed reliably.

Each projection 15 is held by reaction forces produced in the upper and lower shake preventing portions 16 and the left and right shake preventing portions 16. Thus, shaking of the projection 15 relative to the projection insertion hole 32 is prevented reliably.

The projection insertion holes 32 and the projections 15 are held in close contact over substantially the entire lengths of the projecting-portion insertion holes 32 in forward and backward directions. Thus, shaking is prevented more reliably as compared to the case where only parts are held in close contact.

Accordingly, the fluid- or watertight connector C is miniaturized by mounting the seal 27 before the terminal accommodating portion 20A, and relative vibration of the housings 10, 20 can be suppressed and fine sliding abrasion between the male tabs 14 and the female terminal fittings 40 can be prevented.

The invention is not limited to the above described and illustrated embodiment. For example, the following embodiments are also embraced by the technical scope of the present invention as defined by the claims.

The seal 27 is held in close contact with the front surface of the terminal accommodating portion 20A by mounting the front holder 20B on the terminal accommodating portion 20A in the foregoing embodiment. However, the invention is not limited thereto and the seal may be held in close contact with the front surface of the terminal accommodating portion by other means. Further, the cover wall before the seal may be integral to the terminal accommodating portion instead of being separate.

The shake preventing portions 16 are provided on the projections 15 in the foregoing embodiment. However, the invention is not limited thereto and the shake preventing portions may be on the projection insertion holes.

The shake preventing portions 16 are provided at positions to substantially equally divide the entire circumference of each projection 15 into four in the foregoing embodiment. However, the invention is not limited thereto and they may be provided at positions to divide the entire circumference, for example, into two, three or five.

One shake preventing portion 16 is provided at each of the upper, lower, left and right sides, i.e. at opposite positions with respect to the axial line of each projection 15 in the foregoing embodiment. However, the invention is not limited thereto and the shake preventing portions may be arranged at any positions. For example, one projection may be arranged at the upper side and two projections may be arranged at the lower side.

The dimension of the respective shake preventing portions 16 in forward and backward directions is substantially equal to that of the projection insertion holes 32 in forward and backward directions in the foregoing embodiment. However, the invention is not limited thereto and it may be shorter or longer than the dimension of the projection insertion hole in forward and backward directions.

What is claimed is:

1. A fluidtight connector, comprising:

first and second housings connectable with each other, at least one first terminal accommodated in the first housing and projecting from the first housing substantially in a connecting direction with the second housing and connectable with at least one second terminal accommodated in the second housing, a terminal accommodating portion provided in the second housing, including at least one cavity capable accommodating the second terminal and formed with a terminal insertion hole through which the first terminal is insertable into the cavity, at least one seal mounted on a front surface of the terminal accommodating portion with respect to a connecting direction with the first housing and capable of being held in close contact with the front surface in an area where the terminal insertion hole is formed, a cover wall provided in the second housing for at least partly covering a front side of the seal with respect to the connecting direction with the first housing, at least one through hole penetrating the cover wall in the connecting direction at a position substantially corresponding to the terminal insertion hole, at least one projection formed on the first housing and projecting outwardly toward the second housing and along the first terminal, and at least partly covering the outer peripheral surface of a base end of the first terminal and having an outer shape that can be passed through the through hole in close contact with substantially an entire inner peripheral surface of the through hole, and at least one shake preventing portion projecting from at least one of an outer peripheral surface of the projection and the inner peripheral surface of the through hole for closely contacting at least one of the inner peripheral surface of the through hole and the outer peripheral surface of the projection, wherein the shake preventing portion extends over at least part of the length of the through hole in a penetrating direction, wherein rear end portions of the projections are squeezed into the projection insertion holes while having the shake preventing portions deformed.

2. The fluidtight connector of claim 1, further comprising at least one fitting hole penetrating the seal substantially in the connecting direction at a position substantially corresponding to the terminal insertion hole, wherein the at least one through hole penetrates the cover wall in the connecting direction at a position substantially corresponding to the fitting hole.

3. The fluidtight connector of claim 1, wherein the at least one projection is formed on a surface of the first housing where the first terminal projects.

4. The fluidtight connector of claim 1, wherein the projection has an outer shape that can be passed through the through hole in close contact with substantially the entire inner peripheral surface of the fitting hole.

5. The fluidtight connector of claim 1, wherein a plurality of shake preventing portions are arranged at substantially equally circumferentially spaced-apart positions on the outer circumferential surface of the projection or the inner circumferential surface of the through hole.

6. The fluidtight connector of claim 1, wherein at least two shake preventing portions are arranged at substantially opposite positions with respect to an axial line of the projection and the through hole.

7. The fluidtight connector of claim 1, wherein the shake preventing portion extends over the entire length of the through hole in a penetrating direction.

8. A fluidtight connector of claim 1, wherein at least one projecting piece is formed on a rear surface of the cover wall for insertion into a part of the cavity of the terminal accommodating portion to form part of a front end section of at least one wall of the cavity.

9. The fluidtight connector of claim 8, wherein the respective projecting pieces have a length to reach positions immediately before locks provided in the cavity for locking the second terminal therein.

10. A fluidtight connector, comprising:

a female housing having opposite front and rear ends, a terminal accommodating portion at the front end of the female housing, cavities formed in the terminal accommodating portion and terminal insertion holes extending through the front end of the terminal accommodating portion and into the respective cavities;

female terminal fittings mounted respectively in the cavities;

a seal mounted on the front end of the terminal accommodating portion of the female housing;

a front holder mounted on the front end of the female housing and having a cover wall covering the seal, the cover wall having through holes aligned respectively with the terminal insertion holes; and a male housing having a rear wall and a forwardly open receptacle extending forward from the rear wall, the receptacle being configured for receiving at least parts of the female housing and the front holder, male tabs projecting forward from the rear wall into the receptacle at positions for passing through the through holes and the insertion holes and for connection with the female terminal fittings when the female housing is received in the receptacle, projections projecting from the rear wall and surrounding portions of the male tabs adjacent the rear wall, the projections being configured for passing through the through holes, preventing portions projecting from outer peripheral surfaces of the projections for closely contacting inner peripheral surfaces of the through holes, wherein the shake preventing portion extends over at least part of a length of the respective through hole in a penetrating direction, wherein rear end portions of the projections are squeezed into the projection insertion holes while having the shake preventing portions deformed.

11. The fluidtight connector of claim 10, wherein fitting holes penetrate the seal at positions corresponding to the terminal insertion holes and the through holes.

12. The fluidtight connector of claim 10, wherein a plurality of shake preventing portions are arranged at substantially equally circumferentially spaced-apart positions on the outer peripheral surfaces of the projections.

13. The fluidtight connector of claim 10, wherein at least two shake preventing portions are arranged at substantially opposite positions with respect to an axial line of each of the projections.

14. The fluidtight connector of claim 13, wherein each of the shake preventing portions extends over an entire length of the respective through hole in a penetrating direction.

15. A fluidtight connector of claim 10, wherein projecting pieces are formed on a rear surface of the cover wall for insertion into the cavities of the terminal accommodating portion to form parts of front end sections of the respective cavities.

* * * * *